United States Patent [19]

Cunningham

[11] 4,239,834

[45] Dec. 16, 1980

[54] METAL SUBSTRATE FORMATION WITH TORX RECESS MANDREL

[75] Inventor: James R. Cunningham, Collegeville, Pa.

[73] Assignee: Matthey Bishop Incorporated, Malvern, Pa.

[21] Appl. No.: 974,503

[22] Filed: Dec. 29, 1978

[51] Int. Cl.[3] ..... B23B 33/00

[52] U.S. Cl. ..... 428/592; 82/40 R; 279/1 R; 279/1 B

[58] Field of Search ..... 82/40 R; 279/1 R, 1 B; 428/592

[56] References Cited

U.S. PATENT DOCUMENTS

| | | | |
|---|---|---|---|
| 2,611,621 | 9/1952 | Patterson et al. | 279/1 B |
| 2,948,559 | 8/1960 | Recker | 279/1 B |
| 3,096,989 | 7/1963 | Fallon | 279/1 R |
| 3,208,131 | 9/1965 | Ruff et al. | 29/157 |
| 3,770,389 | 10/1973 | Kitzner | 23/28.8 F |

OTHER PUBLICATIONS

Camear Screw & Mfc., Oct. 1968, Ansi B18.3 socket screw.

*Primary Examiner*—Brooks H. Hunt

*Attorney, Agent, or Firm*—Cushman, Darby & Cushman

[57] ABSTRACT

A metal substrate, and a method of construction thereof, utilizing an elongated mandrel having a drilled hole in a first end thereof, and a torx recess in the second end thereof. A web of metal substrate material is affixed to the mandrel, the web including a first web of substantially planar metal foil and a second web of corrugated metal foil. The torx recess of the mandrel is indexed into operative engagement with a male drive bit of a winding machine, and the male drive bit is rotated to wrap the web of metal substrate material around the mandrel while the web is fed to the mandrel and while maintaining tension on the web, until a metal substrate of desired size is obtained. Utilizing the headless torx recess mandrel, indexing problems in the prior art are eliminated and the mandrel is capable of withstanding the torque of the drive bit turning in one direction and a reverse force created by foil tension in the opposite direction.

9 Claims, 6 Drawing Figures

METAL SUBSTRATE FORMATION WITH TORX RECESS MANDREL

BACKGROUND AND SUMMARY OF THE INVENTION

In the formation of metal substrates for catalytic converters and the like, such as shown in U.S. Pat. Nos. 3,208,131 and 3,770,389, it is conventional to wind a web of metal substrate material around a mandrel which is slotted at one end thereof. The slotted end of the mandrel is engaged by a rotatable drive component, which drives the mandrel to effect wrapping. The mandrel is normally manually installed in the winding station of a machine and the metal foils (plain and corrugated) to be wrapped around the mandrel are attached to the mandrel by spot welds.

While the prior art procedures are generally suitable, for high speed production machines the slotted mandrel is inadequate to withstand the imposed torque created during the winding operation as a result of the drive bit turning in one direction while a reverse force created by foil tension is applied in an opposite direction. Additionally, with such prior art systems if automatic indexing of the mandrel into operative association with the drive bit—as opposed to manual insertion—is practiced, up to 359° of rotation could be provided, while still providing no guarantee of proper indexing.

According to the present invention, a metal substrate—and method of formation thereof—are provided which eliminate the problems present in the prior art for high speed production. The present invention is practised by forming a torx recess in one end of the mandrel. The torx configuration provides a generally star-shaped recess having smooth curved portions extending between the rounded points of the star. This configuration is eminently suitable for high torque use, and because of the numerous indexing points automatic indexing of the mandrel into operative position with a male drive bit may be provided.

The metal substrate according to the present invention comprises an elongated mandrel having first and second ends; a plurality of wrappings of metal substrate material disposed around the mandrel, and including alternate layers of planar metal foil and corrugated metal foil; means for maintaining the wrappings and mandrel integral; a drilled hole in the first end of the mandrel; and a torx recess formed in second end of the mandrel. Preferably the mandrel is headless, the second end having a slight decreasing taper (e.g. 2°) from the mandrel body toward the second end, and is formed of Inconel.

According to the method of the present invention a metal substrate is formed utilizing a winding machine having a male drive bit, the winding machine being completely automatic. An elongated mandrel is provided, having first and second ends, a drilled hole being provided in the first end and a torx recess being provided in the second end. A web of metal substrate material is affixed to the mandrel, the torx recess of the mandrel is automatically indexed into operative engagement with the male drive bit of the winding machine, and the male drive bit is rotated to wrap the web of metal substrate material around the mandrel, while the web of metal substrate material is fed to the mandrel and while maintaining tension on the web of metal substrate material, until a metal substrate of desired size is obtained. The web is cut and the cut-end is attached to an underlying portion of the metal substrate. The mandrel may be automatically fed into a position to be indexed into operative engagement with the male drive bit of the winding machine. The mandrel is formed from an elongated rod by punching a torx recess into the second end of the rod, and removing the head formed during punching by turning the rod on a lathe, or by shearing the head off by moving a cutting die parallel to the direction of elongation of the rod.

It is the primary object of the present invention to provide a metal substrate and method of formation thereof which may be produced in practice with fully automated, high production machinery. This and other objects of the invention will become clear from an inspection of the detailed description of the invention, and from the appended claims.

DETAILED DESCRIPTION OF THE DRAWINGS

Figure 1:
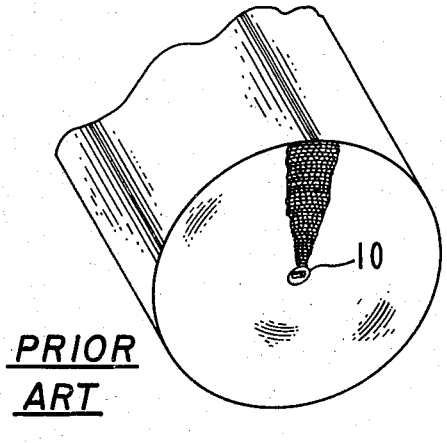
FIG. 1 is a perspective view of an exemplary metal substrate of the prior art.

A conventional prior art metal substrate for catalytic converters and the like is shown in FIG. 1, the metal substrate including a slotted end mandrel 10. In formation of such prior art metal substrates, the slotted end mandrel 10 is manually inserted into a winding station and the winding station drives the mandrel via the slotted end. For high speed production, and for automatic feeding of the mandrel into operative association with the drive bit of the winding station, the prior art mandrel 10 is not acceptable.

Figure 2:
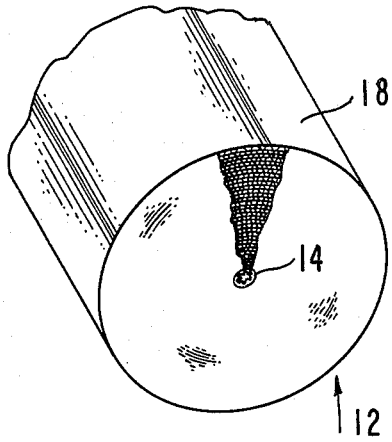
FIG. 2 is a perspective view of a metal substrate according the present invention.
Figure 5:
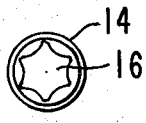
FIG. 5 is an end view of the mandrel of FIG. 4 showing the torx recess.

A metal substrate according to the present invention is shown generally at 12 in FIG. 2, and includes a mandrel 14 having a conventional drilled hole 15 (see FIG. 4 in particular) at a first end thereof, and having a torx recess 16 formed at a second end thereof. Alternate layers of planar and corrugated metal foil are disposed around the mandrel 14, and the wrappings and mandrel are maintained integral by conventional welds or the like 18 for attaching the top layer of foil to an underlying portion of the metal substrate 12. The torx recess is a recess having a general star configuration with curved portions interconnecting the rounded points of the star, as indicated most clearly in FIG. 5. The torx recess 16 when mating with a male drill bit 20 (see FIG. 6) of a high speed winding machine 21 may be driven at high speed and may be automatically fed by the winding machine 21 into position to be indexed into operative engagement with the male drive bit 20 of the winding machine 21.

Figure 4:
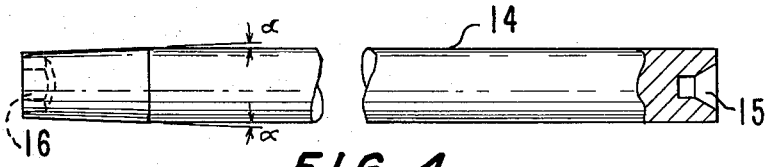
FIG. 4 is a side view, with portions broken away for clarity, of the mandrel of FIG. 3.
Figure 3:
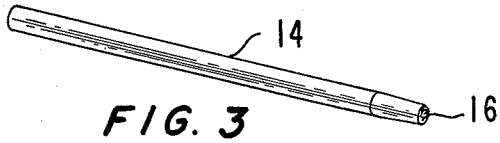
FIG. 3 is a perspective view of an exemplary mandrel utilized in the practice of the invention.

The mandrel 14 preferably is made of Inconel, and is headless. During formation of the mandrel 14, the torx recess 16 is formed by a punch punching the recess into the second end of the rod forming the mandrel 14, a head being formed during the punching of the torx recess 16. The head is removed by shearing it off by moving a cutting die parallel to the direction of elongation of the rod, or by turning on a lathe. Preferably, the second end which has the torx recess 16 has a slight decreasing taper (e.g. the angle $\alpha$ in FIG. 4 is about 2°) from the mandrel body toward the second end having the recess 16.

Figure 6:
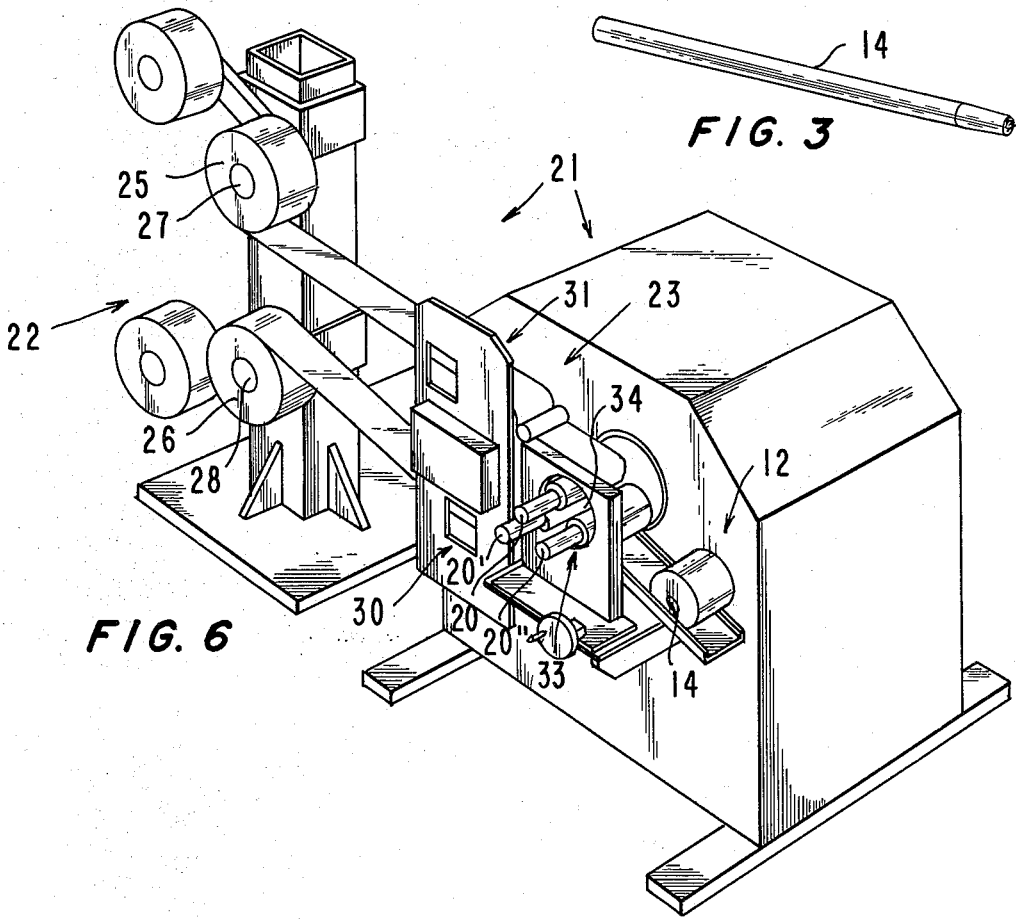
FIG. 6 is a perspective view of the automatic winding machine for producing metal substrates according to the invention.

A high speed production winding machine 21 with which the mandrels 14 are utilized to construct metal substrates 12 according to the present invention is illustrated schematically in FIG. 6. The machine 21 includes a dual cantilever payoff station 22, and a corrugating, tensioning, and winding assembly 23. Coils 25, 26 of foil used in making the metal substrate 12 are mounted on spindles 27, 28 and the assembly, the reels 25, 26 being unwound during operation of the machine 21 to form the metal substrates.

A corrugating station 30 is provided in assembly 23, this station automatically corrugating the foil from the reel 26 before feeding it to be wound onto a mandrel 14. Proper tension is provided to the foil from the reel 25 at station 31.

The winding station 33 includes a turret 34 containing three individual stations, each station indexing sequentially and performing a different function at three different positions. At the first position, a mandrel 14 is automatically fed into a position, and is indexed into operative engagement with a male drive bit 20 of the machine 21, the male drive 20 positively locking up with the torx recess 16 at the mandrel second end. The mandrel and its associated drill bit 20 then index into another position wherein foil from the reels 25,26 is attached to the mandrel 14 (as by welding), and then rotation of the drill bit 20 is effected to wind the alternating planar and corrugated layers from reels 25,26 onto the mandrel. The mandrel 14 must be capable of withstanding the torque of the drive bit 20 turning in one direction and a reverse force created by foil tension being applied in the opposite direction, and the mandrel 14 according to the present invention is readily capable of same.

After completion of the winding operation, the turret 34 is indexed into another position wherein a cutting knife cuts both foils and the cut-ends thereof are automatically welded to an underlying portion of the metal substrate 12, and the finished metal substrate 12 is automatically ejected from the winding station, as illustrated in FIG. 6. With the turret 34 located at one position, other operations are taking place associated with the drill bits 20', 20'' at the other turret positions, so that a constant feeding of mandrels, winding of the mandrels, and securing of the substrates is effected, resulting in higher production.

It will thus be seen that according to the present invention a metal substrate capable of being produced in a rapid manner fully automatically has been provided, as well as a high speed method of formation thereof. While the invention has been herein shown and described in what is presently concieved to be the most practical preferred embodiment thereof, it will apparent to those of ordinary skill in the art and many modifications may be made thereof within the scope of the present invention, which scope is to accorded the broadest interpretation of the appended claims so as to encompass all equivalent structures and methods.

What is claimed is:

1. A metal substrate comprising an elongated Inconel mandrel having a body and first and second ends; a plurality of wrappings of metal substrate material disposed around said mandrel, and including alternate layers of planar metal foil and corrugated metal foil; means for maintaining said wrappings and mandrel integral; said mandrel having a drilled hole in said first end thereof; and a torx recess formed in said mandrel second end, said second end being headless and having a slight taper from the mandrel body toward the second end.

2. A method of high speed production of metal substrates, utilizing a winding machine, comprising the steps of providing an elongated mandrel having a body and first and second ends, a drilled hole being provided in the first end of the mandrel, and a torx recess in the second end of the mandrel, with the second end being headless and having a slight taper from the mandrel body toward the second end;

affixing a web of metal substrate material to the mandrel, the web including a first web of substantially planar metal foil and a second web of corrugated metal foil;

automatically indexing the torx recess of the mandrel into operative engagement with a male drive bit of the winding machine;

rotating the male drive bit to wrap the web of metal substrate material around the mandrel, while the web of metal substrate material is fed to the mandrel and while maintaining tension on the web of metal substrate material, until a metal substrate of desired size is obtained; and cutting the web of metal substrate material, and attaching the cut end thereof to underlying portion of the metal substrate.

3. A method as recite in claim 2 wherein said method comprise the further step of automatically feeding the mandrel into position to be indexed into operative engagement with the male drive bit of the winding machine.

4. A method as recited in claim 2 comprising the further step of automatically forming the second web by corrugating a generally planar foil web, just prior to feeding of the second web to the mandrel to be wrapped therearound.

5. A method as recited in claim 2 comprising the further step of automatically ejecting the completed metal substrate from the winding machine after completion, and automatically feeding another mandrel into position for the formation of a subsequent metal substrate.

6. A method as recited in claim 2 wherein the mandrel is formed from an elongated rod by punching a torx recess into the second end of the rod, and removing the head formed during punching the torx recess into the rod second end.

7. A method as recited in claim 6 wherein the mandrel is formed of Inconel.

8. A method as recited in claim 7 wherein the head is removed by shearing it off by moving a cutting die parallel to the direction of elongation of the rod.

9. A method as recited in claim 7 wherein the head is removed by turning on a lathe.

* * * * *